US006276403B1

(12) United States Patent
Shaw

(10) Patent No.: US 6,276,403 B1
(45) Date of Patent: Aug. 21, 2001

(54) GRIPPER WEAVING MACHINE WITH GUIDE ELEMENTS

(75) Inventor: Henry Shaw, Steenvoorde (FR)

(73) Assignee: Picanol N.V., Ypres (BE)

( * ) Notice: Subject to any disclaimer, the term of this patent is extended or adjusted under 35 U.S.C. 154(b) by 0 days.

(21) Appl. No.: 09/355,976

(22) PCT Filed: Feb. 20, 1998

(86) PCT No.: PCT/EP98/00988

§ 371 Date: Sep. 29, 1999

§ 102(e) Date: Sep. 29, 1999

(87) PCT Pub. No.: WO98/38366

PCT Pub. Date: Sep. 3, 1999

(30) Foreign Application Priority Data

Feb. 24, 1997 (FR) ..... 9700165

(51) Int. Cl.[7] ..... D03D 47/27

(52) U.S. Cl. ..... 139/449

(58) Field of Search ..... 139/449

(56) References Cited

U.S. PATENT DOCUMENTS 3,299,911 * 1/1967 Dewas ..... 139/449
4,977,932 * 12/1990 Pezzoli ..... 139/449
5,176,185 * 1/1993 Reheinganz et al. ..... 139/449

* cited by examiner

*Primary Examiner*—Andy Falik
(74) *Attorney, Agent, or Firm*—Bacon & Thomas, PLLC

(57) ABSTRACT

A gripper weaving machine with a plurality of guiding devices(28) for guiding gripper carrying rapiers (1,2). The guiding devices (28) have two rows of guiding elements (35,36) with two guiding surfaces (37,38) that are associated with the bottom side of the rapiers (1,2). The guiding elements (35,36) are oriented relative to the bottom side of the rapiers (1,2) such that they form, at the side facing the reed (13), obtuse angles (B,B',C,C') with the bottom side of the rapiers (1,2).

16 Claims, 9 Drawing Sheets

FIG. 3
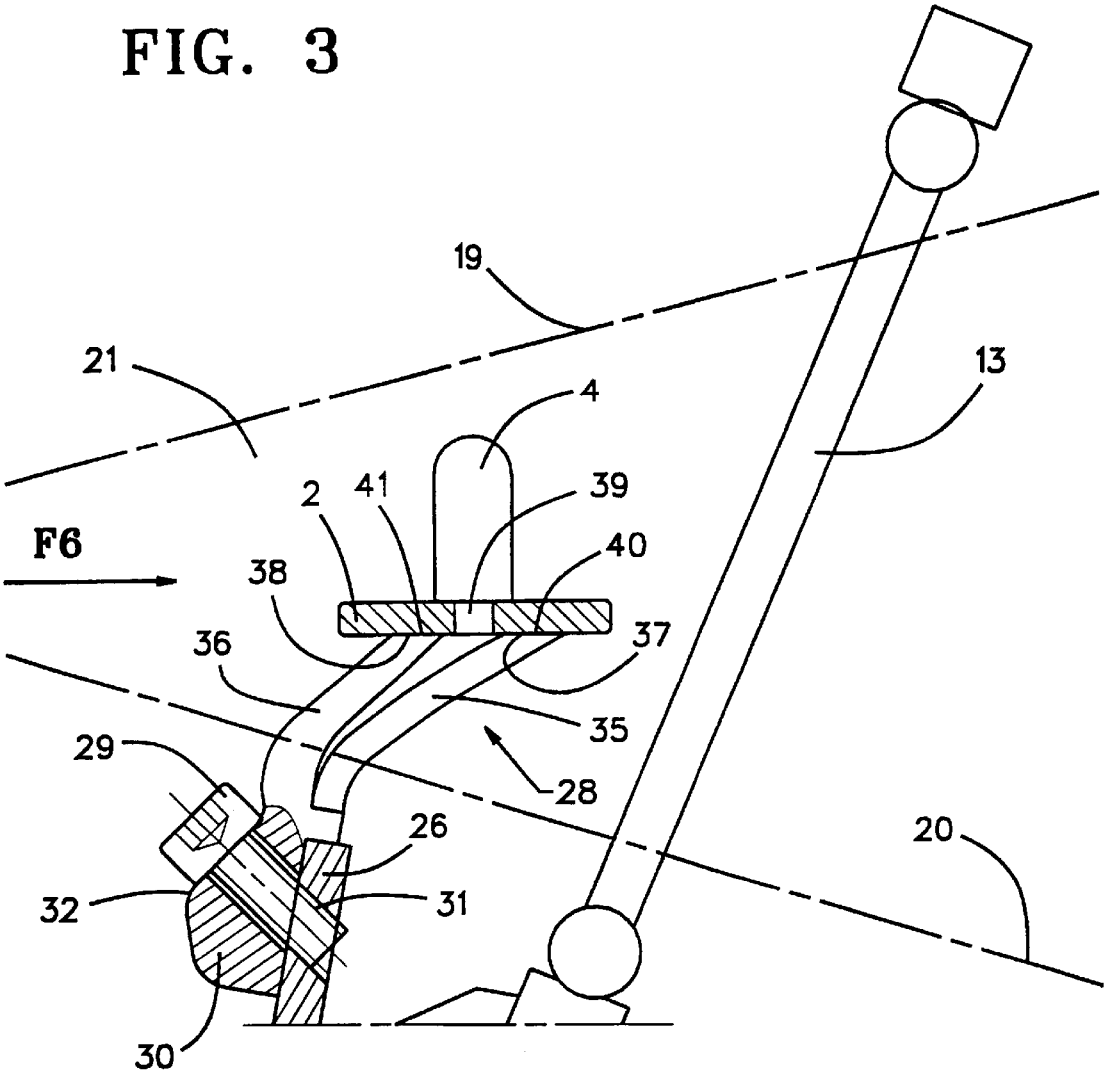
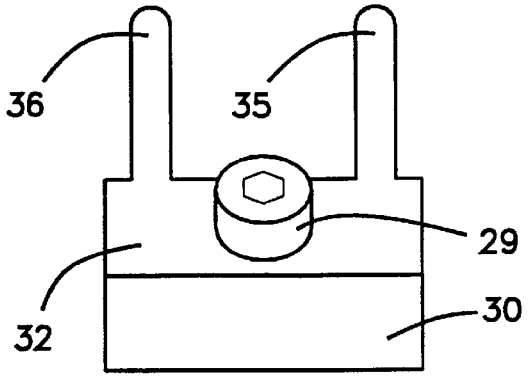
FIG. 6
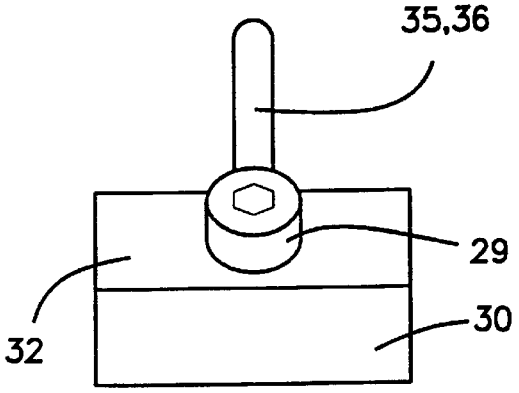
FIG. 8

GRIPPER WEAVING MACHINE WITH GUIDE ELEMENTS

BACKGROUND OF THE INVENTION

1. Field of the Invention

The invention relates to a gripper weaving machine comprising a gripper which can be moved into and out of the shed and mounted to a rapier associated with guides which can be moved into and out of the shed through the warp sheet, and to guides for guiding a rapier.

2. Description of the Related Art

A gripper weaving machine of the above type is known from U.S. Pat. No. 5,183,084. Guide elements mounted in two rows are used to guide the rapier. The guide elements of the row facing the reed are mounted in a guide surface of the rapier. The guide elements of the row facing away from the reed are hook-shaped and enclose a side edge of the rapier. Such hook-shaped guide elements increase the danger of causing rupture of and/or damage to the warp threads when being moved into the shed and out again through the warp sheet.

SUMMARY OF THE INVENTION

The objective of the invention is to so design a gripper weaving machine and in particular, its guide elements such that the danger of the guide elements damaging the warp threads is substantially reduced.

This problem is solved by two guide surfaces on the underside of the rapier that are associated with the guide elements mounted in two rows wherein at least the segment of the guide elements passing through the warp sheet subtends at obtuse angles relative to the underside of the rapier at least in the vicinity of the rapier on the reed side.

As a result of the invention, the warp threads are stressed lower when the guide elements are moved into and out of the shed. This feature is most advantageous for warp threads having knots or nubs or other irregularities since the threads will slide along the guide elements without undue danger that they will snag on the guide elements.

Advantageously, and especially as regard to a maximally open shed, the guide elements will subtend at an obtuse angle on the side away from the shed relative to the warp sheet they have penetrated. As a result there is further reduction in the danger that the nubs or knots will snag, especially during the withdrawing motion from the shed as during closing which might damage the warps.

Preferably the upper edges of all guide elements will be in their positions below the surface of the underside of the rapier. The upper edges of all guide elements may then guide the underside of the rapier.

In another embodiment, a guide structure is located at least in the vicinity of the end of the rapier where the gripper is present and is guided by the guide elements. In a further design the underside of the rapier includes a guide structure at least in the vicinity of the end of the rapier where the gripper is located and is guided by the guide elements. In another design, a guidance part is mounted in the extension of the rapier in the vicinity of the gripper and is guided by the guide elements. This guidance part may include a guide structure that is guided by the guide elements. A guide structure affixed to the rapier and/or a guide structure of the rapier may be used in the extension of the guide structure of the guide. As a result, the gripper and/or the segment of the rapier in the region of the gripper may be guided transversely of the direction of motion of the rapier.

In the invention, guides to guide a rapier always includes at least two guide elements of which the upper edges are located in one plane and which are associated with two mutually parallel guide surfaces of the underside of the rapier.

BRIEF DESCRIPTION OF THE DRAWINGS

Further features and advantages of the invention will be evident from in the description below of the illustrative embodiments shown in the drawings.

FIG. 3 is an enlarged view of FIG. 2 in the region of a rapier aperture.

FIG. 6 is a detailed front view in the direction of the arrow F6 in FIG. 3.

FIG. 8 is another variant of a guide corresponding to the front view of FIG. 6.

DETAILED DESCRIPTION OF THE PREFERRED EMBODIMENTS

Figure 1:
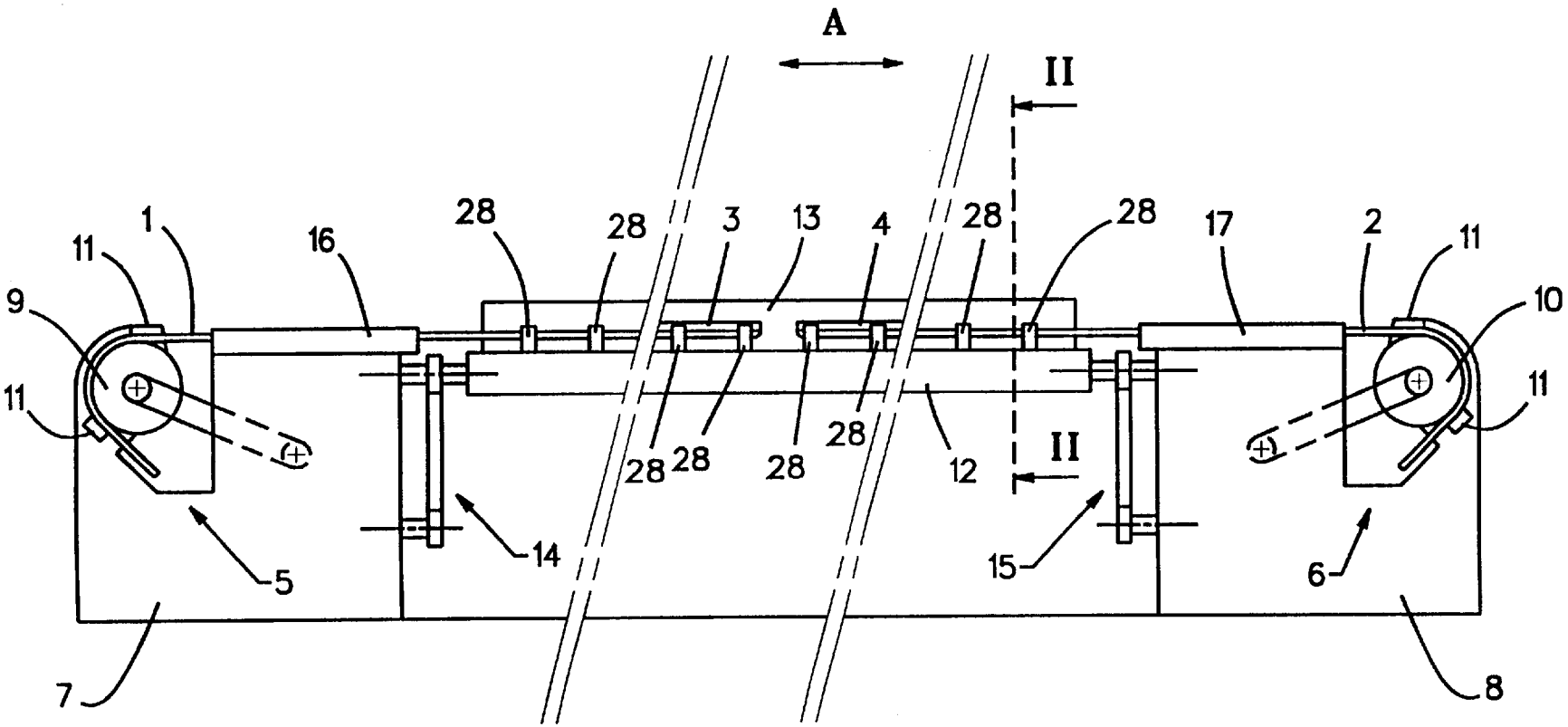
FIG. 1 is a schematic view of a gripper weaving machine with a plurality of guides of the invention in a position wherein the guides cooperate with the rapiers.

The gripper weaving machine shown in FIGS. 1 through 6 comprises two rapiers 1, 2. A feed gripper 3 is mounted at the end of the rapier 1 and a receiving gripper 4 is mounted at the end of the rapier 2. These grippers are inserted in the filling direction A into the shed and then are withdrawn. The rapier 1 driven a rapier drive device 5 moves the feed gripper 3 together with the filling (weft thread) to be inserted from the filling feed side to the center of the shed. There the receiving gripper 4, moved in a corresponding manner by the rapier 2 driven a rapier drive device 6, grips the filling and moves it to the opposite side of the shed. The drive devices 5, 6 are respectively mounted in side frames 7, 8 of the gripper weaving machine and include toothed wheels 9, 10 driven by drive elements, wheels 9,10, cooperating respectively with the rapiers 1, 2. The rapiers 1, 2 are held in contact with wheels 9,10 by guide fittings 11.

The gripper weaving machine also includes a batten 12 to which is affixed a reed 13 which rests in the side frames 7 and 8. The batten 12 is reciprocally driven by batten devices 14, 15. The batten drive devices 14, 15 and the repier devices 5, 6 are preferably operated synchronously. The rapiers 1, 2 are guided in the region of the side frames 7, 8 by stationary guides 16, 17.

Figure 2:
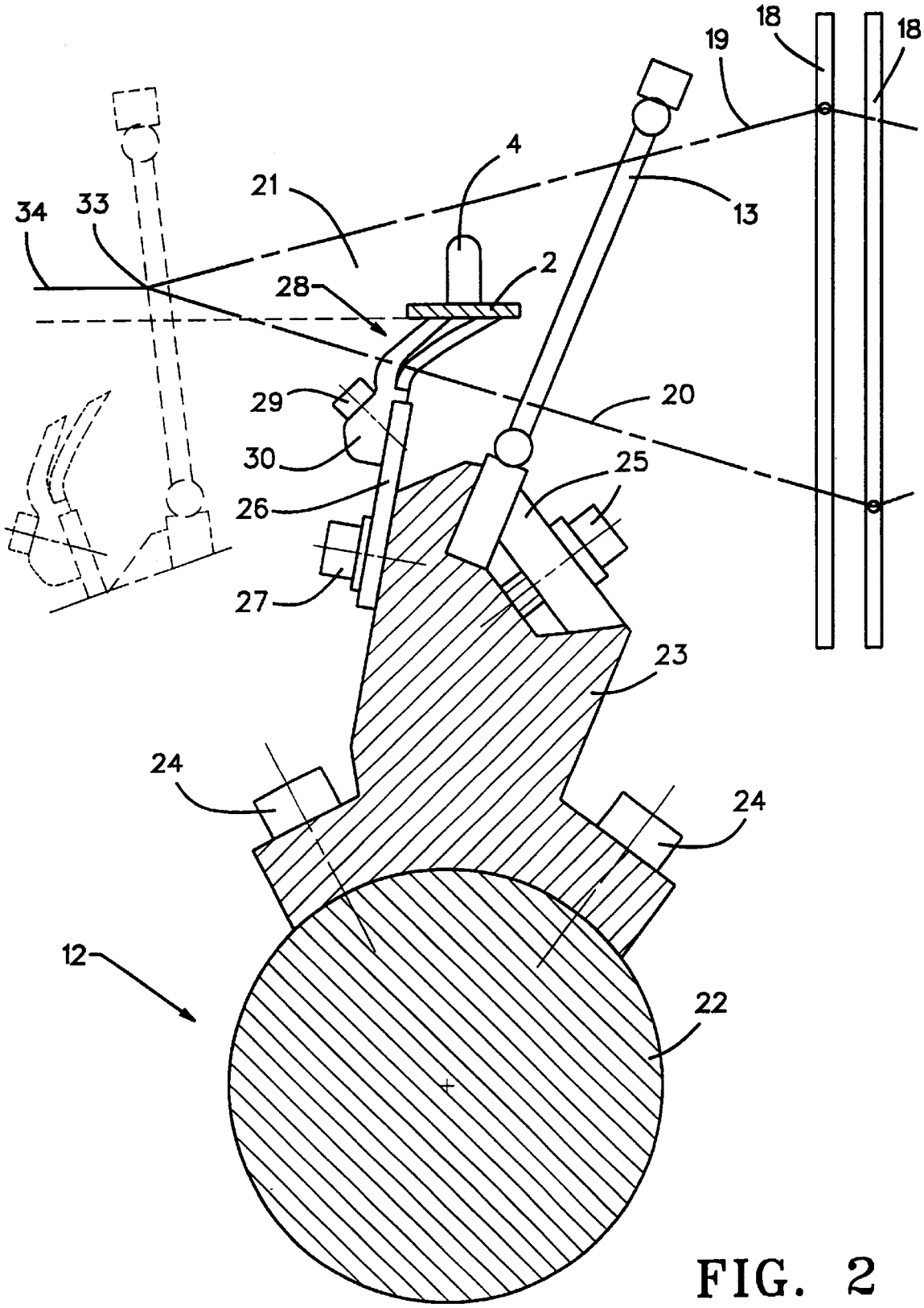
FIG. 2 is an enlarged cross-sectional view taken along line II—II of FIG. 1.

As schematically shown by FIG. 2, the gripper weaving machine further includes a shed forming device 18 which may be raised and lowered by a shed driving device (not shown in the drawings) and may be operated synchronously with the batten drive device 14, 15. FIG. 2 also shows two warp sheets 19, 20 between which a shed 21 is formed and which receives a filling thread. These warp sheets 19, 20 are formed by the shed-forming device 18, of which only two are shown and which are raised and lowered according to a predetermined pattern.

The batten 12 includes a batten shaft 22 to which a contoured batten section 23 is affixed by screws 24. The reed 13 is affixed by fasteners 25 to the contoured batten section 23. Furthermore an intermediate contoured section 26 is affixed by screws 27 to the contoured batten section 23, and a plurality of guides 28 according to the invention are affixed to this contoured intermediate section 26.

The individual guides 28 are affixed by a screw 29 passing through a retention fitting 30 of the guides 28 and screwed into a thread 31 in the intermediate contoured section 26. The thread 31 runs at an angle deviating from the perpendicular of the intermediate contoured section 26. The retention fitting 30 is provided with a slanted surface 32 perpendicular to the thread 31 and supporting the head of the screw 29.

By the reciprocating motion of the batten 12, the plurality of the guides 28 are moved through the lower warp sheet 20 into and then out of the shed 21. In this process, the guides 28 move in a plane passing through the lower warp sheet 20 which itself runs perpendicularly to the filling direction A.

FIG. 2 shows the position wherein the guides 28 have penetrated the shed 21 due to the pivoting motion of the batten 12, the shed 21 at this position is at a maximally open position. In this position, the guides 28 guide the underside of the rapiers 1, 2. Their guide edges are in a substantially horizontal plane as shown in dashed lines in FIG. 2 and located underneath a beatup edge 33 of a fabric 34 against which the inserted fillings will be beaten by the reed as shown by the dashed lines at the left in FIG. 2.

Figure 4:
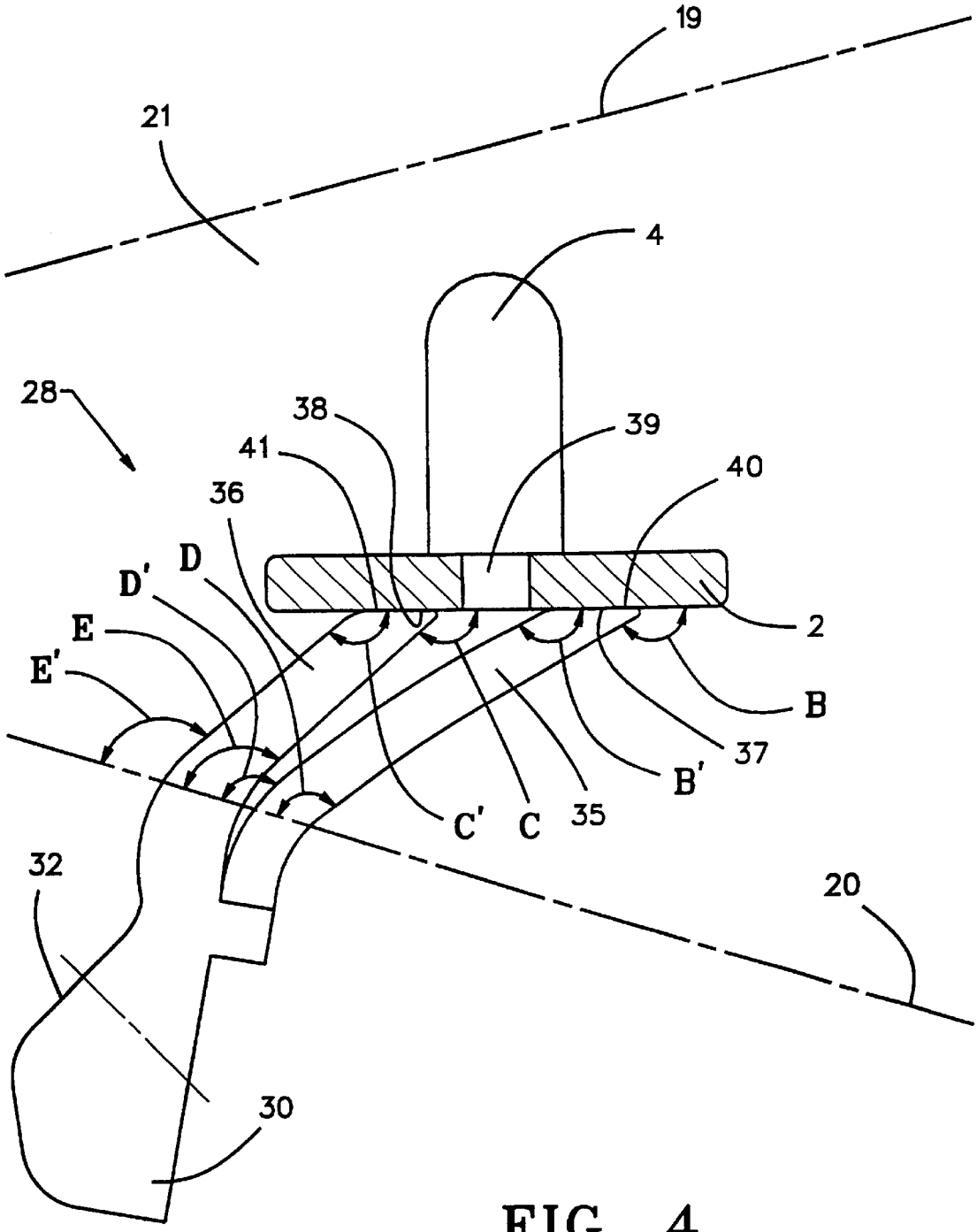
FIG. 4 is a further enlarged view of FIG. 3.

As shown on a larger scale in FIGS. 3 and 4, the guides 28 include two different guide elements 35, 36 generally parallel but diverging over their full lengths, and mounted on the retention fitting 30. The plurality of the guide elements 35 and the plurality of the guide elements 36 are each mounted in a row running in the longitudinal direction of the batten 12 and hence in the direction of motion of the rapiers 1, 2. The row of guide elements 35 terminate at ends guiding the underside of the rapiers 1, 2 along a guide surface 37 facing the reed 13. The row of guide elements 36 guides the underside of the rapiers 1, 2 along an adjacent guide surface 38 facing away from the reed 13. Accordingly, the row of guide elements 35 is located between the row of guide elements 36 and the reed 13. As shown in FIG. 6, each guide element 35 is offset relative to a guide element 36 in the filling direction A at the retention fitting 30.

As shown in FIG. 4, which shows in enlarged detail the position of the guides 28 having guide elements 35 and 36 in the position described in relation to FIG. 2, the bar-shaped or rod-shaped guide elements 35 and 36 project toward the underside of the rapiers 1, 2 such that they subtend guide surface 37 at their ends in each case at obtuse angles B, B' and C, C' of about 120 to 150°. The essentially rectilinear segments of the guide elements 35, 36 which penetrate through the warp sheet 20 into the shed 21 and which in the filling direction A are thinner than in a transverse direction of the same, and, at least in the vicinity of the rapiers 1,2, subtend these angles B, B' and C, C', by their side edges facing the reed 13. These side edges being located in a plane perpendicular to the filling direction A, and to the underside of the rapiers 1, 2. In the shown embodiment, the angles B and B, and C and C' are approximately equal. The guide elements 35, 36 slanting toward the reed 13 due to of their rounded upper edges 40, 41 guide the guide surfaces 37, 38 of the rapiers 1, 2, the latter being located in a substantially horizontal plane, as a result of which the rapiers 1, 2 are supported substantially horizontally. As further shown by FIG. 4, the guide elements 35, 36 in this preferred embodiment include a substantially straight segment over the part of the length penetrating the shed 21.

Figure 5:
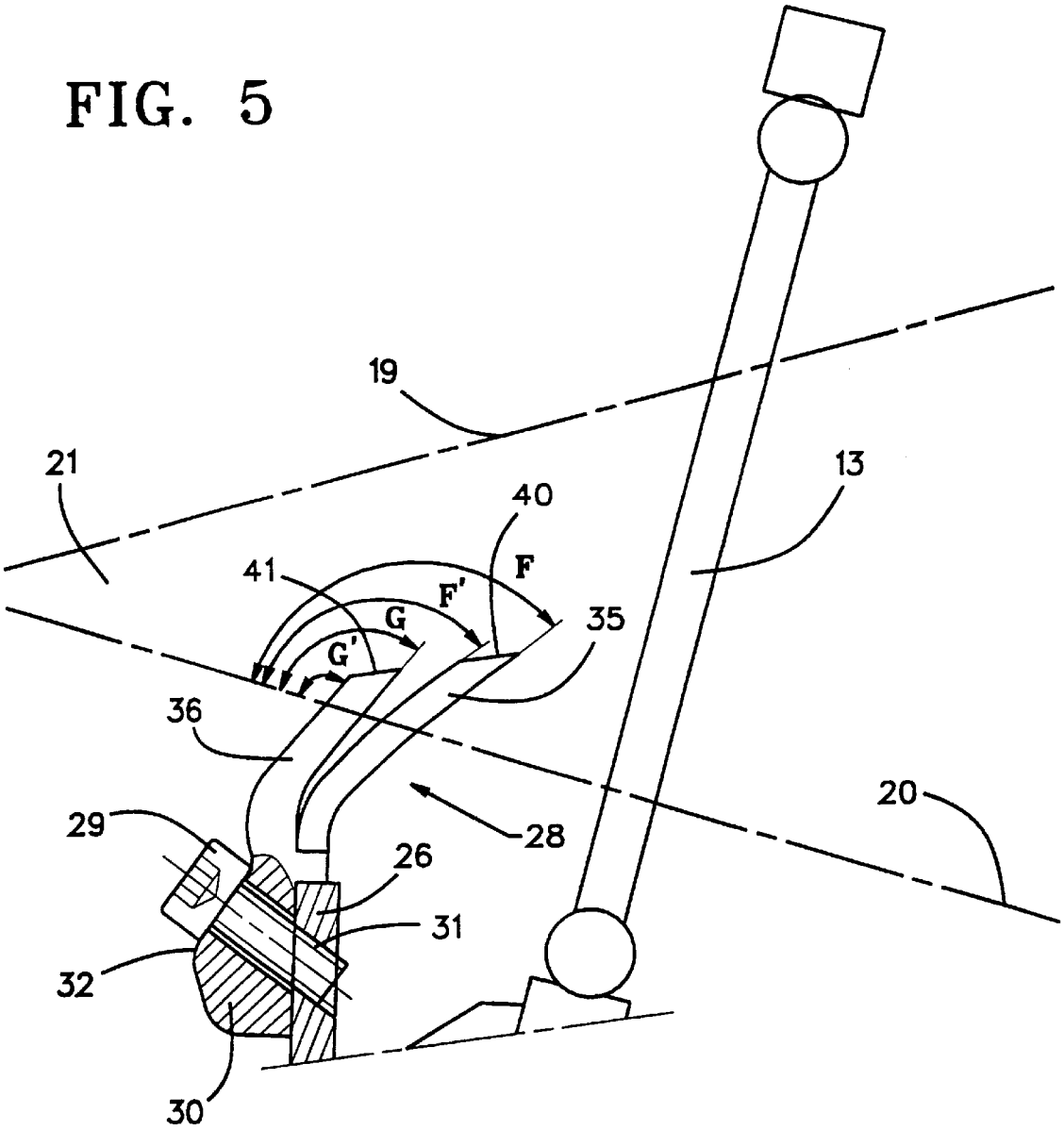
FIG. 5 is a view of FIG. 3 during the insertion of the guides into a shed.

As further shown by FIG. 4, the guide elements 35, 36 are arrayed in such manner that, on the side away from the reed 13, they subtend obtuse angles D, D' and E, E' relative to the threads of the warp sheet 20 between their side faces and the warp sheet 20. As shown in FIG. 5, the side faces of the guide elements 35, 36 also subtend obtuse angles F, F' and G, G' on the side away from the reed 13 relative to the warp sheet 20, while the guide elements 35, 36 move into or out of the opening and closing shed 21 respectively. As shown by FIGS. 4 and 5, the angles D, D', the angles E, E', the angles F, F' and the angles G, G' are substantially all of the same magnitude.

In the position of FIGS. 2, 3 and 4, wherein the guides 28 cooperate with the rapier 1, 2, the upper edges 40, 41 of the guide elements 35, 36 will guide the underside either of the rapier 1, 2. It follows that the upper edges of the guide elements 35, 36 in all other positions of these guide elements 35, 36 will be located underneath the plane defined by the underside of the rapiers 1, 2.

The rapiers 1, 2 are provided with apertures 39 (shown in FIGS. 4 and 10) cooperating with the teeth of the wheels 9, 10. As shown in FIG. 3, these apertures 39 are located substantially at the center of the rapiers 1, 2. The guide elements 35, 36 are arrayed in such manner that they will not guide the rapiers 1, 2 in the region of these apertures and accordingly, no wear by the guide elements 35, 36 will take place in the region of said apertures.

As previously mentioned and as may be seen in FIGS. 4, 5 and 6, the upper edges of the guide elements 35, 36 are rounded to reduce the danger of damaging the rapiers 1, 2 or the warps of the warp sheet 20.

Because the underside of the rapiers 1, 2 runs on the upper edges 40, 41 of the guide elements 35, 36, the side edges of the guide elements 35, 36 subtend with these upper edges 40, 41 on the side facing the reed 13 at the same obtuse angles B, B' and C, C'. The upper edges 40, 41 of the guide elements run in a plane which is perpendicular to the filling direction A.

Figure 7:
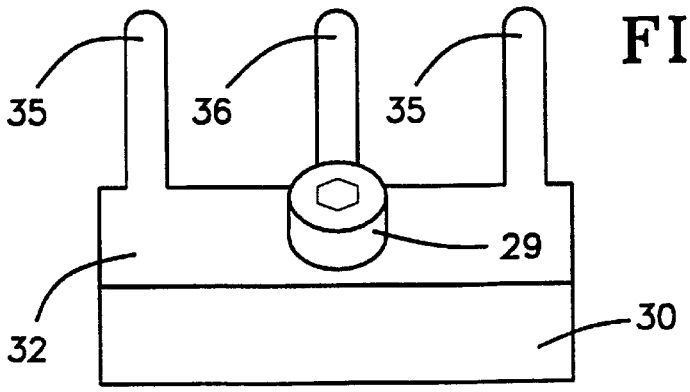
FIG. 7 is a variation of the guide, having three guide elements, and corresponding to the front view of FIG. 6.

As shown by FIG. 7, two guide elements 35 and one guide element 36 are used for each retention fitting 30. The guide element 36 is mounted between the two guide elements 35.

Figure 9:
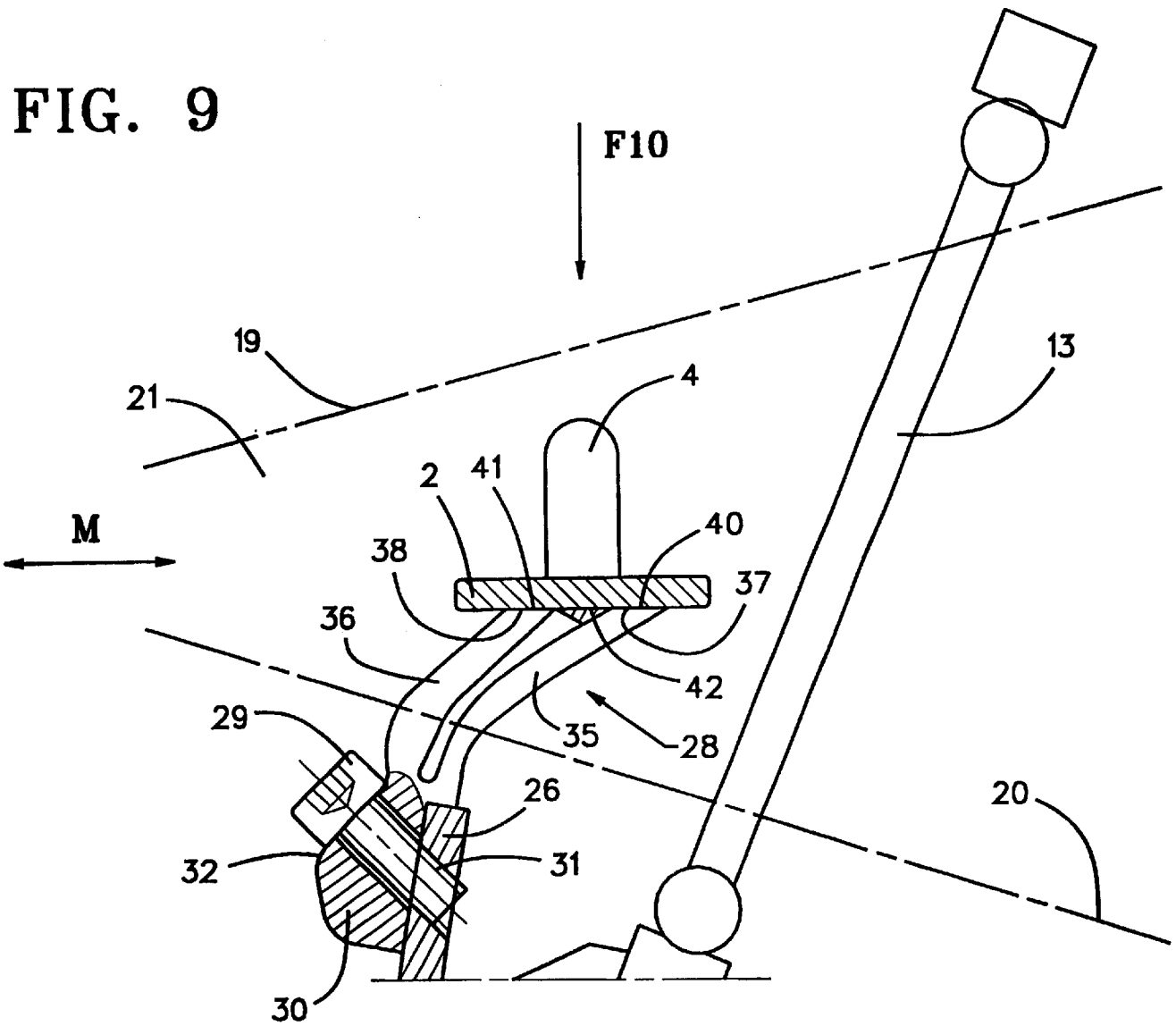
FIG. 9 is a partially sectional, elevational view, similar to FIG. 3 of an embodiment with the guides of FIG. 8.
Figure 10:
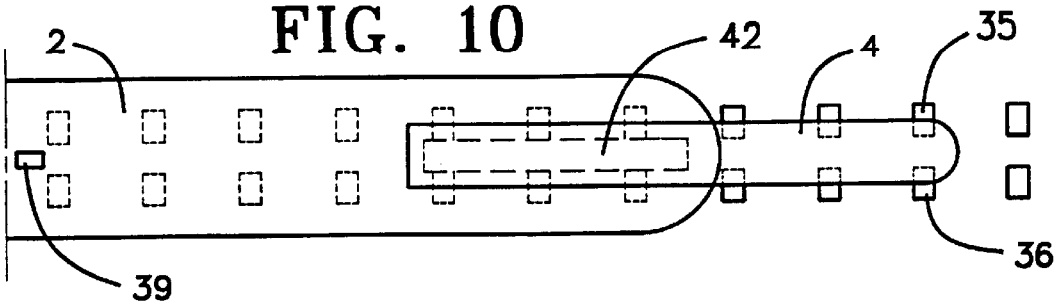
FIG. 10 is a partial elevational view in the direction of the arrow F10 of FIG. 9.

As shown in FIGS. 8, 9 and 10, the guide elements 35 and 36 are mounted in a common plane which is perpendicular to the filling direction A, as a result of which the guide elements 35 and 36 can be inserted between the warps of the warp sheet 20 into the shed 21. The guide elements 35 and 36 are of such length that the retention fitting 30 and the site at which the two guide elements 35,36 are joined remain underneath the lower guide warp sheet 20, whereby a warp that is to be gripped between the two guide elements 35, 36 can always reach the warp sheet 20 during shed formation.

As shown in FIGS. 9 and 10, a guide structure 42 is mounted in the region of the ends of the rapiers 1, 2 where the grippers 3, 4 are located at each underside of these rapiers 1, 2 and is guided between the guide elements 35 and 36. This features precludes the rapiers 1, 2 from moving in the transverse direction M and consequently they cannot deviate toward or away from the reed 13. The guide structure 42 in this embodiment has a triangular cross-section.

Figure 12:
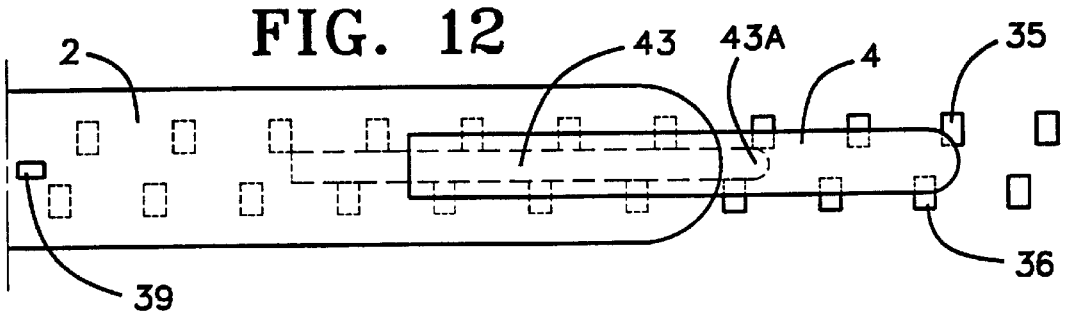
FIG. 12 is a top view of an embodiment similar to FIG. 10.
Figure 11:
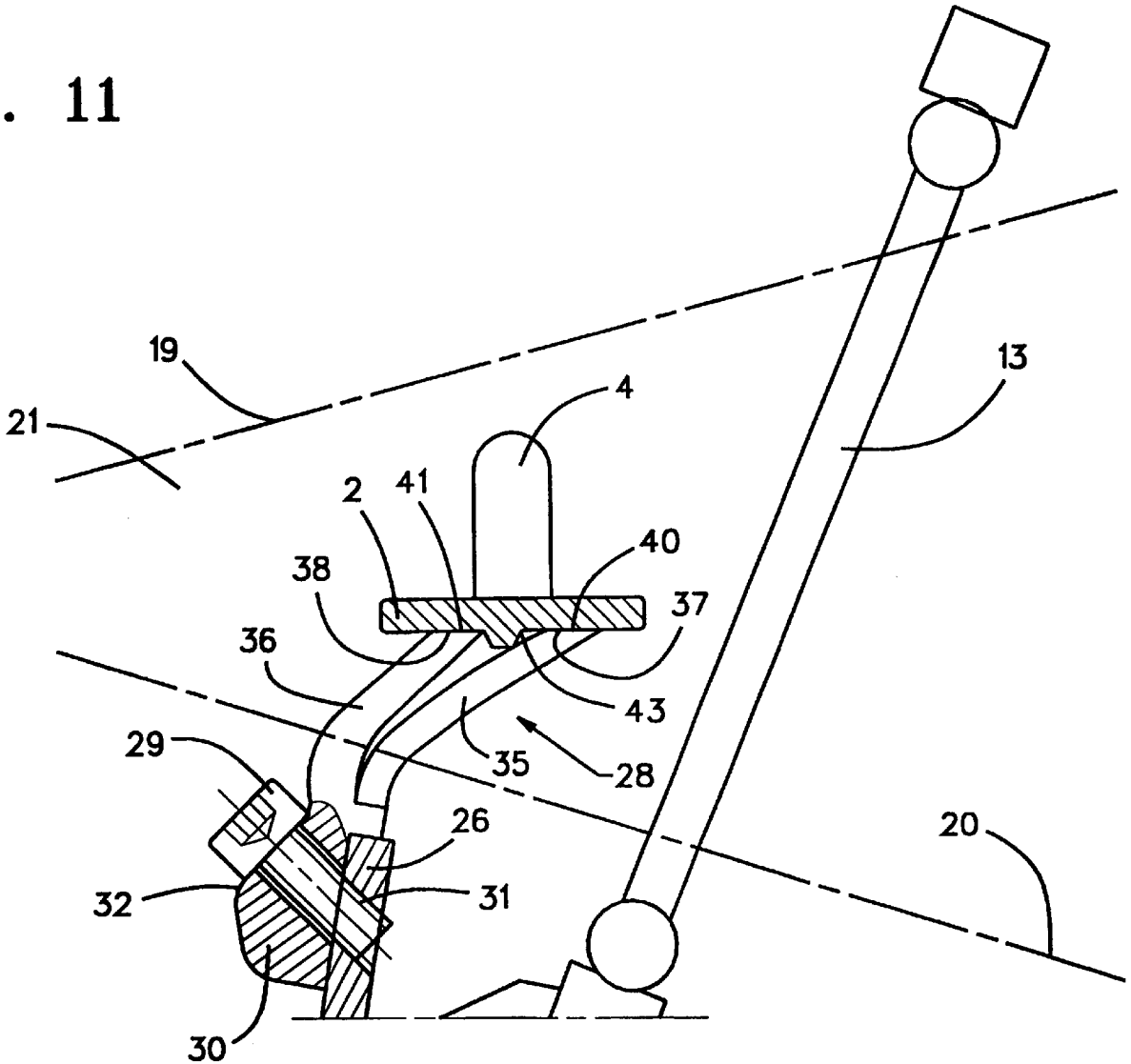
FIG. 11 is a partial elevational view similar to FIG. 3 of an embodiment with guides corresponding to FIG. 6.

A guide structure 43 which is present in the embodiment of FIGS. 11 and 12 in the region of the end of the rapiers 1, 2 where the grippers 3, 4 are located at the underside of these rapiers 1, 2, is guided between the guide elements 35, 36. In this embodiment the guide structure 43 is in each case integral with the rapiers 1, 2. Illustratively, the, guide structure 43 projects itself with a portion 43A beyond the rapiers 1, 2. The guide structure 43 of this embodiment has a trapezoidal cross-section.

The guide structure 43 is located underneath the underside of the rapiers 1, 2 and is thereby also underneath the plane subtended by the upper edges 40, 41 of the guide elements 35, 36. Because in this embodiment the guide structure 43 extends by its front part 43A beyond the end of the rapiers 1, 2, it is able to move warps that snag on one of the upper edges 41, 42 of the guide elements 35, 36 from these upper edges 40, 41 before these upper edges are within reach of the underside of the rapiers 1, 2. FIG. 11 clearly shows that the guide structure 43 per se does not touch the upper edges 40, 41 of the guide elements 35, 36.

Figure 14:
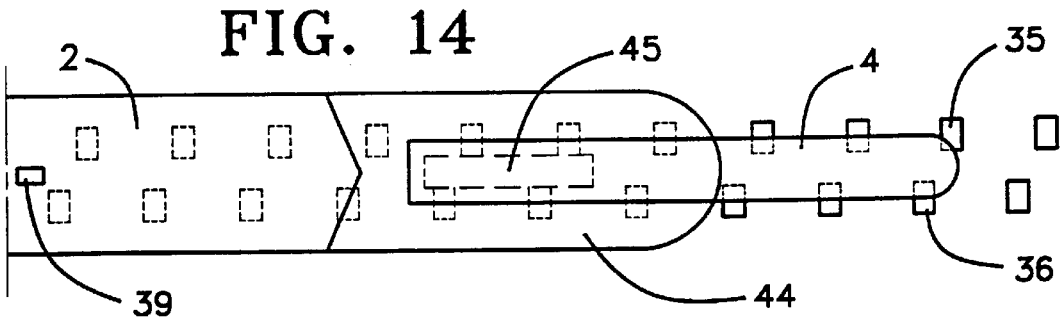
Figure 13:
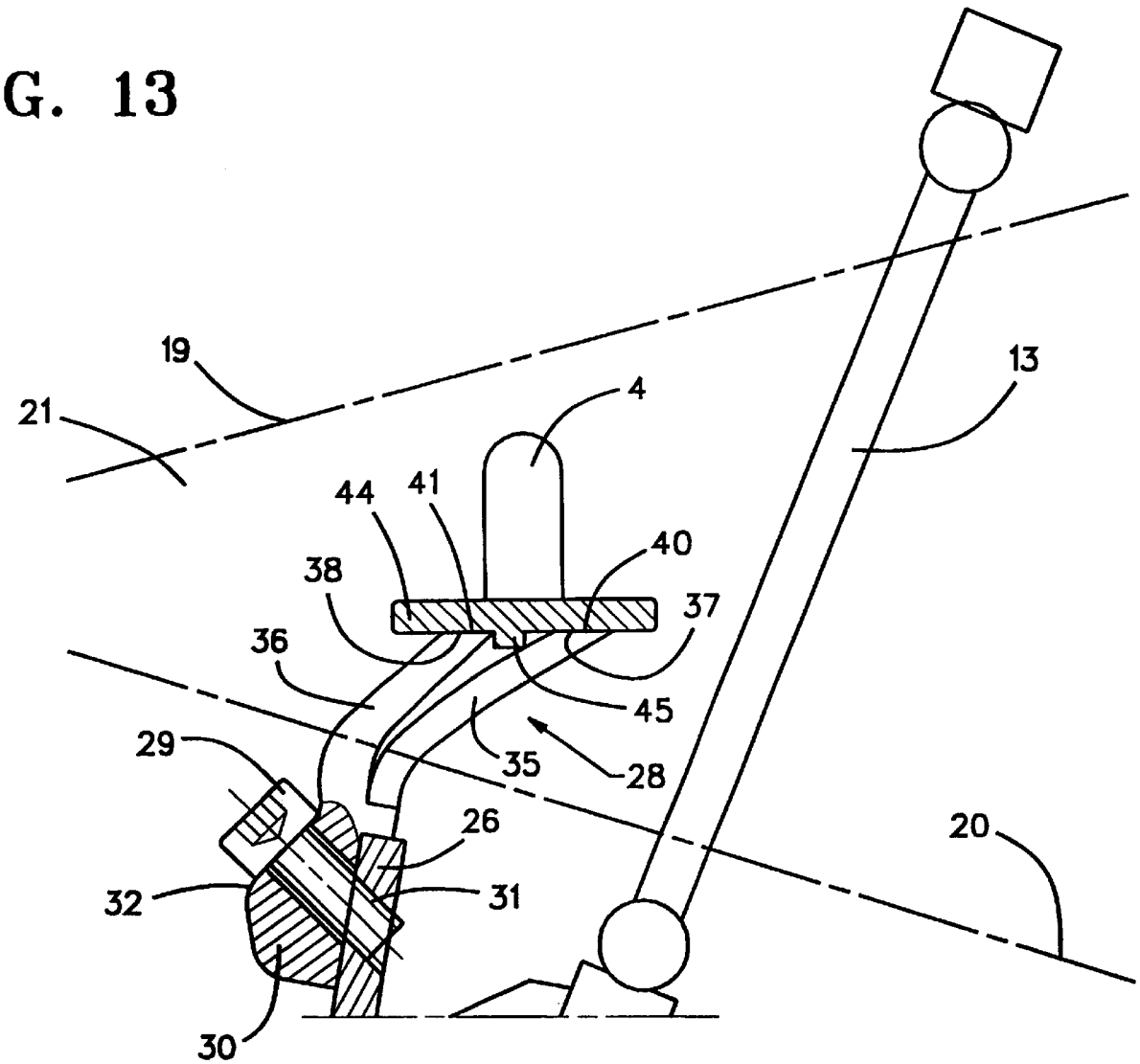
FIG. 13 is a partially sectional elevational view of an embodiment configured with the guides of FIG. 6, and FIGS. 14 through 16 are views similar to FIG. 10 of another embodiment variants.

A guidance part 44 is mounted in the extension of the rapiers 1, 2 in the region of the grippers 3, 4 of the embodiment shown in FIGS. 13 and 14. The underside of the guidance part 44 being flush with the underside of the rapiers 1, 2, as a result of which this part's underside is guided by the guide elements 35, 36. This guidance part 44 is provided with a downward-projecting guide structure 45 that is guided between the guide elements 35, 36. The guide structure 45 is integral with the guidance part 44. In this embodiment the guide structure 45 is mounted at a distance from the front end of the guidance part 44 and as a result, the grippers 3, 4 can be inserted into the shed 21, in a manner similar to U.S. Pat. No. 5,183,084, readily before the guides 28 reach their end position as shown in FIG. 13. The cross-section of the guide structure 45 is rectangular.

Figure 15:
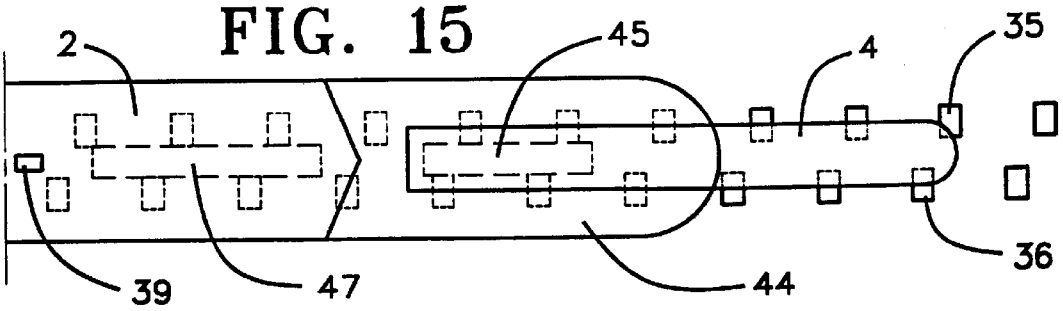

At the ends of the rapiers 1, 2, a guidance part 44 is provided with a guide structure 45 in the embodiment of FIG. 15 also corresponding to that of FIGS. 13 and 14. A guide structure 47 is present in the extension of the guide structure 45 at the rapiers 1, 2. This design includes a safety space in the longitudinal direction between the guide structure 45 of the guidance part 44 and the guide structure 47 of the rapiers 1, 2.

Figure 16:
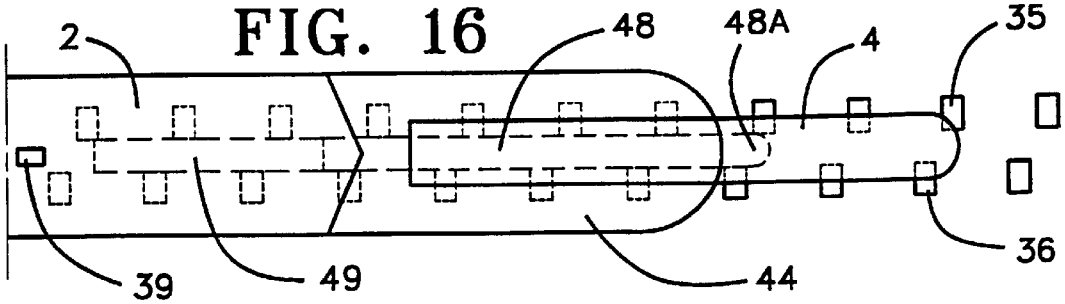

A guidance part 44 is present in the illustrative embodiment of FIG. 16 and comprises a guide structure 48. Each rapier 1,2 is provided with one guide structure 49 in the extension of the guide structure 48. The guide structures 49 directly adjoin the guide structure 48 of the guidance parts 44. The guide structure 48 projects by a part 48A beyond the front edge of the guidance parts 44. This design therefore offers the same advantages already described as regard to the guide structure 43 with its front part 43A as shown in FIGS. 11 and 12.

The cross-sections of the guide structures 42, 43, 45, 47, 48, 49 may be triangular, rectangular or trapezoidal or other shape. These guide structures are designed in such a way that they can be guided between the guide elements 35 and 36 so that they preclude the rapiers 1,2 from moving to or from the reed 13.

Practically all known grippers may be used as grippers 3, 4, for instance those shown in U.S. Pat. Nos. 4,708,174 or 4,860,800.

The invention is not restricted to the shown and described illustrative embodiments. In particular, modifications and/or combinations within the knowledge of persons skilled in the art may be undertaken without departing from the scope of the invention defined by the attached claims. In particular the invention may also may be applied to gripper weaving machines having only one gripper driven by one rapier and moving, in this case between the side of filling insertion and the opposite side of the machine.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

What is claimed is:

1. A gripper weaving machine comprising at least one gripper (3, 4) movable into and out of a shed and mounted on a rapier (1, 2) having an underside and associated guide elements (35, 36) which are movable through a warp sheet (20) into and out of the shed (21), wherein the guide elements (35, 36) are arranged in two rows and are associated with two guide surfaces (37, 38) positioned at the underside of the rapier (1, 2), at least a portion of the guide elements (35, 36) penetrating the warp sheet (20) when the portion of the guide elements moves into the warp sheet, the guide elements (35, 36) facing a reed (13) and forming at least in the vicinity of the rapier (1, 2) obtuse angles (B, B', C, C') with the underside of the rapier (1, 2); and wherein all of the guide elements extend toward the reed and form the obtuse angles.

2. The gripper weaving machine as claimed in claim 1, said guide elements including a side facing toward and a side facing away from the reed, and wherein the side facing away from the reed (13) forms an obtuse angle (E, E', D, D') with the warp sheet (20) that is penetrated by the guide elements (35, 36).

3. The gripper weaving machine as claimed in claim 1, wherein the guide elements (35, 36) are inclined relative to the reed (13).

4. The gripper weaving machine as claimed in claim 1, wherein the guide elements (35, 36) are associated at their upper edges (40, 41) with the underside of the rapier (1, 2).

5. The gripper weaving machine as claimed in claim 4, wherein the underside of the rapier (1, 2) is guided by the upper edges (40, 41) of the guide elements (35, 36) in a substantially horizontal plane located below a beatup edge (33) of a fabric (34).

6. The gripper weaving machine as claimed in claim 1, wherein the rapier (1, 2) has, approximately at its center, apertures (39) and the guide surfaces (37, 38) are provided one on each side of the apertures.

7. The gripper weaving machine as claimed in claim 1, wherein a guidance part (44) is present in an extension at an end of the rapier (1, 2) in the vicinity of the gripper (3, 4) and is guided by the guide elements (35, 36).

8. The gripper weaving machine as claimed in claim 7, wherein the guidance part (44) is configured with a guide structure (45, 48) which is guided transversely to the direction of motion of the rapier (1, 2) by the guide elements (35, 36).

9. The gripper weaving machine as claimed in claim 1, wherein the gripper (3, 4) includes an end region where the gripper (3,4) is mounted, and the rapier (1, 2) is configured with a guide structure (42, 43, 47, 49) guided transversely to the direction of motion of the rapier (1, 2) by the guide elements (35, 36).

10. The gripper weaving machine as claimed in claim 1, wherein the guide elements (35, 36) include side edges and upper edges (40, 41); and a first guide structure (42, 43, 47, 49) of the rapier (1, 2) and/or a second guide structure (45, 48) of a guidance part (44) is guided between the upper edges (40, 41) of the guide elements (35, 36) facing the underside of the rapier (1, 2) at the side edges of the guide elements.

11. The gripper weaving machine as claimed in claim 1, wherein a guide structure (43) of the rapier (1, 2) or a guide structure (48) of a guidance part (44) project beyond the end of the rapier (1, 2) or beyond the end of the guidance part (44).

12. A guide for guiding a planar underside of a rapier in a rapier weaving machine, the guide comprising:

a retention fitting (30) securable on a batten of a weaving machine;

a pair of guide elements (35, 36) mounted on and extending upwardly away from said retention fitting (30) and tilted towards a same direction away from the retention fitting, the guide elements diverging and offset relative to each other over their full lengths and terminating at respective upper edges (40, 41); and the upper edges (40, 41) terminating at a common plane such that said guide elements (35, 36) subtend said plane at obtuse angles (B, B', C, C') at their respective upper edges (40, 41), such that the upper edges (40, 41) define planar guide surfaces for engaging a planar underside of a rapier of a weaving machine.

13. The guide as claimed in claim 12, wherein said obtuse angles are about 120 to 150 degrees.

14. The guide is claimed in claim 12 wherein said obtuse angles are equal.

15. A gripper weaving machine comprising at least one gripper (3, 4) movable into and out of a shed and mounted on a rapier (1, 2) having an underside and associated guide elements (35, 36) which are movable through a warp sheet (20) into and out of the shed (21), wherein the guide elements (35, 36) are generally parallel and diverging and offset relative to each other to terminate at respective upper edges (40, 41), the guide elements (35, 36) arranged in two rows and are associated with two guide surfaces (37, 38) positioned at the underside of the rapier (1, 2), at least a portion of the guide elements (35, 36) penetrating the warp sheet (20) when the portion of the guide elements moves into the warp sheet, the upper edges (40, 41) intersecting a common plane such that the guide elements (35, 36) extend toward and face a reed (13) and forming at least in the vicinity of the rapier (1, 2) obtuse angles (B, B', C, C') with the underside of the rapier (1, 2); and wherein all of the guide elements extend toward the reed and form the obtuse angles.

16. The gripper weaving machine as claimed in claim 15, said guide elements including a side facing toward and a side facing away from the reed, and wherein the side facing away from the reed (13) forms an obtuse angle (E, E', D, D') with the warp sheet (20) that is penetrated by the guide elements (35, 36).

* * * * *

UNITED STATES PATENT AND TRADEMARK OFFICE

CERTIFICATE OF CORRECTION

PATENT NO. : 6,276,403 B1
DATED : August 21, 2001
INVENTOR(S) : Shaw

It is certified that error appears in the above-identified patent and that said Letters Patent is hereby corrected as shown below:

Title page,
Item [30], please change "(F R)" to read -- (BE) --.

Signed and Sealed this

Second Day of July, 2002

*Attest:*

*Attesting Officer*

JAMES E. ROGAN
*Director of the United States Patent and Trademark Office*